US005104418A

United States Patent [19]

Genova et al.

[11] Patent Number: 5,104,418

[45] Date of Patent: Apr. 14, 1992

[54] HYBRID DIESEL FUEL COMPOSITION

[75] Inventors: Calogero Genova, Vizzolo Predabissi, Italy; Irena Blute, Lidingö , Sweden; Rosario Pappa, Monterotondo, Italy

[73] Assignee: Eniricerche S.p.A., Milan, Italy

[21] Appl. No.: 529,179

[22] Filed: May 25, 1990

[30] Foreign Application Priority Data

May 26, 1989 [IT] Italy ..... 20651 A/89

[51] Int. Cl.[5] ..... C10L 1/32

[52] U.S. Cl. ..... 44/302; 44/301

[58] Field of Search ..... 44/301, 302

[56] References Cited

U.S. PATENT DOCUMENTS 4,115,313 9/1978 Lyon et al. ..... 44/301

4,347,061 8/1982 Madsen et al. ..... 44/301

4,465,494 8/1984 Bourfel et al. ..... 44/301

4,770,670 9/1988 Hazbun et al. ..... 44/301

OTHER PUBLICATIONS

Osipow, L., et al., Industrial and Engineering Chemistry, vol. 48, No. 9, Sep. 1956, pp. 1459–1466.

*Primary Examiner*—Prince E. Willis

*Assistant Examiner*—Ellen McAvoy

*Attorney, Agent, or Firm*—Hedman, Gibson, Costigan & Hoare

[57] ABSTRACT

A hybrid diesel fuel composition in the form of a microemulsion stable with time over a wide temperature range comprises a diesel fuel, water, a glycolipid surfactant and an aliphatic alcohol co-surfactant.

20 Claims, 6 Drawing Sheets

HYBRID DIESEL FUEL COMPOSITION

Figure 1:
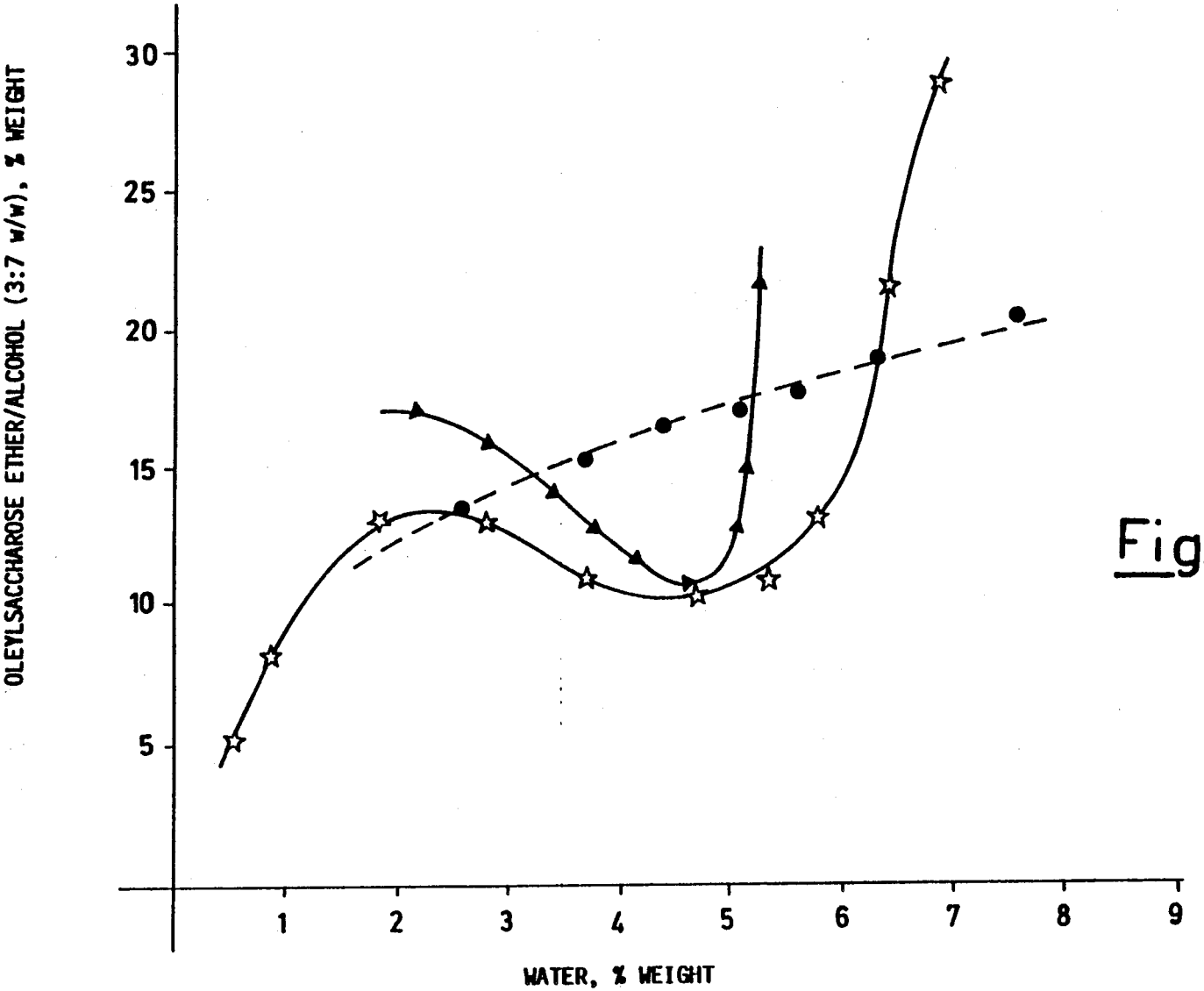

This invention relates to a hybrid diesel fuel composition in the form of a microemulsion which is stable with time over a wide temperature range.

In recent years much research has been done in the alternative fuel and hybrid fuel sector. In particular, in the diesel fuel sector hybrid compositions have been proposed containing an alcoholic fraction, especially methanol and ethanol. The problems associated with these hybrid compositions are of various kinds the most important of which derive from the water-intolerance, phase separation and rheological characteristics of such compositions. For example, methanol itself is insoluble in diesel fuel. Ethanol, which is considered the most interesting from the point of view of availability and combustion characteristics, is miscible with diesel fuel in all proportions, but even a small quantity of water is sufficient to induce phase separation. Consequently research has been directed towards diesel fuel compositions possessing greater water tolerance, a further reason being that water improves the fuel performance by lowering its combustion temperature and reducing smoke emission and nitrogen oxide formation.

One path followed in attempting to solve these problems was to transform the composition containing diesel fuel, lower alcohols and water into a stable emulsion or microemulsion with the aid of a surfactant or mixture of surfactants as described for example in U.S. Pat. Nos. 4,451,265 and 4,447,258. However the proposed solutions are not completely satisfactory. For example, large surfactant quantities are generally needed to obtain emulsions or microemulsions, to the disadvantage of cost. In addition, such emulsions or microemulsions generally have a stability temperature range which is too narrow for practical purposes. Finally, the water quantity which can be incorporated into the emulsion or microemulsion is generally less than the optimum quantity which would produce the best smoke emission and nitrogen oxide reduction during combustion.

It has now been found that the use of a glycolipid surfactant together with an alcoholic co-surfactant produces microemulsions of water in diesel fuel which possess unexpectedly good overall characteristics.

Specifically, these improved characteristics are such that:

- microemulsions of water in diesel fuel can be obtained having considerable stability both at low and at high temperature;
- said microemulsions can be prepared with small quantities of glycolipid/alcoholic co-surfactant quantities;
- the glycolipid surfactant, consisting only of hydrogen, carbon and oxygen, introduces no pollutant during combustion of the diesel fuel, and forms no ash;

This therefore solves the aforesaid problems relative to compositions of the known art.

In accordance therewith, the present invention provides a hybrid diesel fuel composition in the form of a microemulsion stable with time over a wide temperature range, and comprising a diesel fuel, water, a glycolipid surfactant and an aliphatic alcohol co-surfactant.

In the present description the term "microemulsion" means a colloidal dispersion which is transparent and thermodynamically stable within a temperature range of between about 0° C. and about 80° C., in which the mean diameter of the particles of the dispersed phase (water) is less than one quarter of the wavelength of visible light.

The diesel fuel used in the compositions of the present invention can be any petroleum fraction which satisfies ASTM standards for diesel fuels. Diesel fuel No. 2 is preferred, this being that most commonly used for commerical and agricultural vehicles. The term "glycolipid surfactant" means surface active compounds generally definable by the formula A—X—R where A represents the glucide group of a mono-, di-, tri- or tetra-saccharide, R represents a saturated or unsaturated (monounsaturated or polyunsaturated) linear or branched chain alkyl group containing at least 10 carbon atoms, the two groups A and R being connected together by a function X chosen from ether, ester, acetal and hemiacetal functions.

These glycolipid surfactants can for example be prepared by reacting the saccharide with a suitable alkyl halide (formation of the ether bond) or with a suitable lower aliphatic acid or a relative ester (formation of the ester bond), or with a suitable aliphatic aldehyde (formation of the hemiacetal bond). In these reactions, saccharide monosubstitution products form together with smaller quantities of polysubstitution products. According to the present invention, either the monosubstitution products can be separated for use as glycolipid surfactants or the mono- and poly-substituted product mixture can be used for the same purpose. In the preferred embodiment the saccharide is saccharose and the alkyl chain contains from 10 to 24 carbon atoms. Specific examples of glycolipid surfactants are: oleyl saccharose ether, tetradecyl saccharose ether, dodecyl saccharose ether, saccharose oleate, saccharose linoleate and saccharose ether produced from the commercial alcohols LIAL 145 (mixture of $C_{14}$–$C_{15}$ secondary alcohols) of Enichem Augusta S.p.A. after transforming into the relative alkyl halides. With regard to the glycolipid surfactants and the process for their preparation, reference should be made to L. Osipow et al., Industrial and Engineering Chemistry, vol. 48, No. 9, Sept. 1956, pages 1459–1461; B. Havlinova et al., Tenside Detergents 15 (1978) 2, pages 72–74 and 15 (1978) 3, pages 119–121.

Finally, the compositions of the present invention contain a primary or secondary aliphatic alcohol co-surfactant with from 4 to 6 carbon atoms in the molecule. A mixture of various alcohol isomers with the same number of carbon atoms or a mixture of alcohols of different chain lengths, containing an average of between 4 and 6 carbon atoms can be used. Preferably the linear primary alcohols n-butanol, n-pentanol or n-hexanol are used.

The compositions of the present invention can generally contain the constituents in the following percentage ranges:

| | |
|---|---|
| diesel fuel: | from 60 to 91% by weight |
| water: | from 1 to 10% by weight |
| glycolipid surfactant: | from 1.7 to 9% by weight |
| co-surfactant: | from 6.3 to 21% by weight. |

In the case of a glycolipid surfactant consisting of an alkyl saccharose ether with between 10 and 24 carbon atoms in the alkyl chain, the compositions of the present invention typically contain the following percentage ranges of constitutents:

| | |
|---|---|
| diesel fuel: | from 60 to 90% by weight |
| water: | from 1 to 10% by weight |
| alkyl saccharose ether: | from 2.7 to 9% by weight |
| co-surfactant: | from 6.3 to 21% by weight. |

When oleyl saccharose ether is used as the glycolipid surfactant, the compositions of the present invention preferably contain:

| | |
|---|---|
| diesel fuel: | from 80 to 89.3% by weight |
| water: | from 1 to 6% by weight |
| oleyl saccharose ether: | from 2.9 to 4.2% by weight |
| n-pentanol: | from 6.8 to 9.8% by weight. |

In the case of a glycolipid surfactant consisting of a saccharose alkanoate with between 10 and 24 carbon atoms in the alkanoyl chain, the compositions of the present invention typically contain the following percentage ranges of constitutents:

| | |
|---|---|
| diesel fuel: | from 72.1 to 90.6% by weight |
| water: | from 1 to 8% by weight |
| saccharose alkanoate: | from 1.7 to 4.7% by weight |
| co-surfactant: | from 6.7 to 15.2% by weight. |

When saccharose oleate is used as the glycolipid surfactant, the compositions of the present invention preferably contain:

| | |
|---|---|
| diesel fuel: | from 78.5 to 89.1% by weight |
| water: | from 2 to 8% by weight |
| saccharose oleate: | from 2.2 to 4% by weight |
| n-pentanol: | from 6.7 to 9.5% by weight. |

When saccharose linoleate is used as the glycolipid surfactant, the compositions of the present invention preferably contain:

| | |
|---|---|
| diesel fuel: | from 76.5 to 89% by weight |
| water: | from 2 to 8% by weight |
| saccharose linoleate: | from 1.8 to 4% by weight |
| n-pentanol: | from 7.2 to 11.5% by weight. |

In addition to the aforesaid constituents, the compositions of the present invention can contain small quantities (generally less than 1% by weight) of additives known in the art, such as cetane number improvers, corrosion inhibitors, metal deactivators and antioxidants.

The method of preparing the compositions is not critical in that the microemulsion forms spontaneously by simple contact and homogenization of the constituents.

The compositions of the present invention are thermodynamically stable within an unusually wide temperature range and are able to withstand relatively large water quantities although using only low surfactant/co-surfactant concentrations.

The following experimental examples are given to better illustrate the present invention.

EXAMPLE 1

Samples of water-in-diesel fuel microemulsion are prepared by mixing together water and diesel fuel (diesel fuel No. 2 of Agip Petroli S.p.A.) in various weight ratios and adding metered quantities of surfactant/co-surfactant mixtures until transparent, thermodynamically stable solutions are obtained. The surfactant/co-surfactant mixture used is a homogeneous fluid system consisting of oleyl saccharose ether and a co-surfactant in a weight ratio of 3:7, the co-surfactant being n-butanol, n-pentanol or n-hexanol. The curves of surfactant/co-surfactant mixture concentration against water concentration in the microemulsion are shown in FIG. 1, in which (●----●) indicates the use of n-butanol, (★----★) the use of n-pentanol and (►----►) the use of n-hexanol as co-surfactant.

EXAMPLE 2

Figure 2:
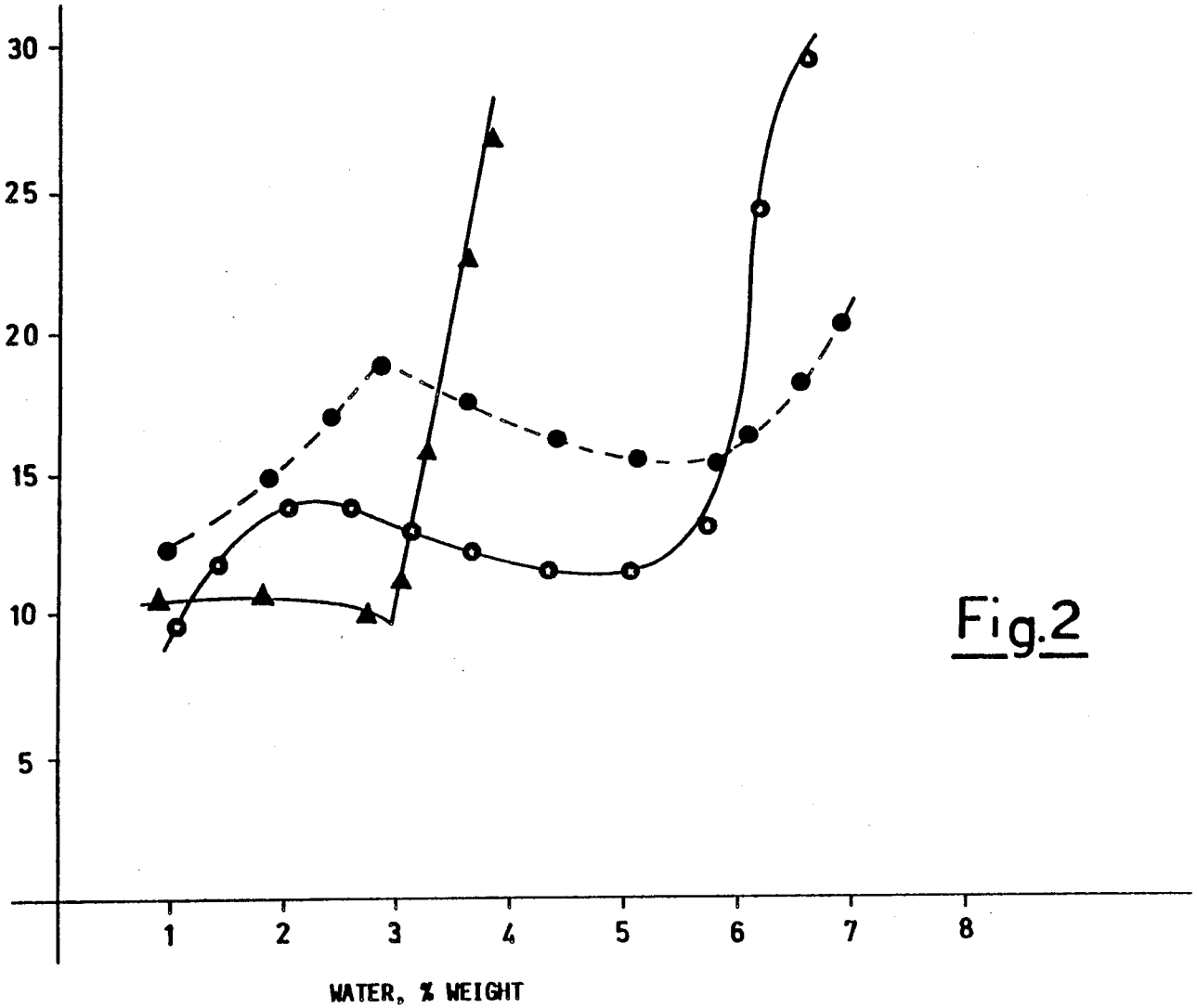

Samples of water-in-diesel fuel microemulsion are prepared by mixing together water and diesel fuel (diesel fuel No. 2 of Agip Petroli S.p.A.) in various weight ratios and adding metered quantities of surfactant/n-pentanol mixtures in different weight ratios until transparent, time-stable solutions are obtained. The surfactant used is that of Example 1. The surfactant/n-pentanol weight ratios used vary from 0.25/1 to 0.67/1. The concentrations of surfactant/n-pentanol mixture as a function of the water concentration to obtain a microemulsion are shown in FIG. 2. This figure shows curves for surfactant/n-pentanol weight ratios of 20:80 (▲----▲), 30:70 (◉----◉) and 40:60 (●----●).

EXAMPLE 3

Figure 3:
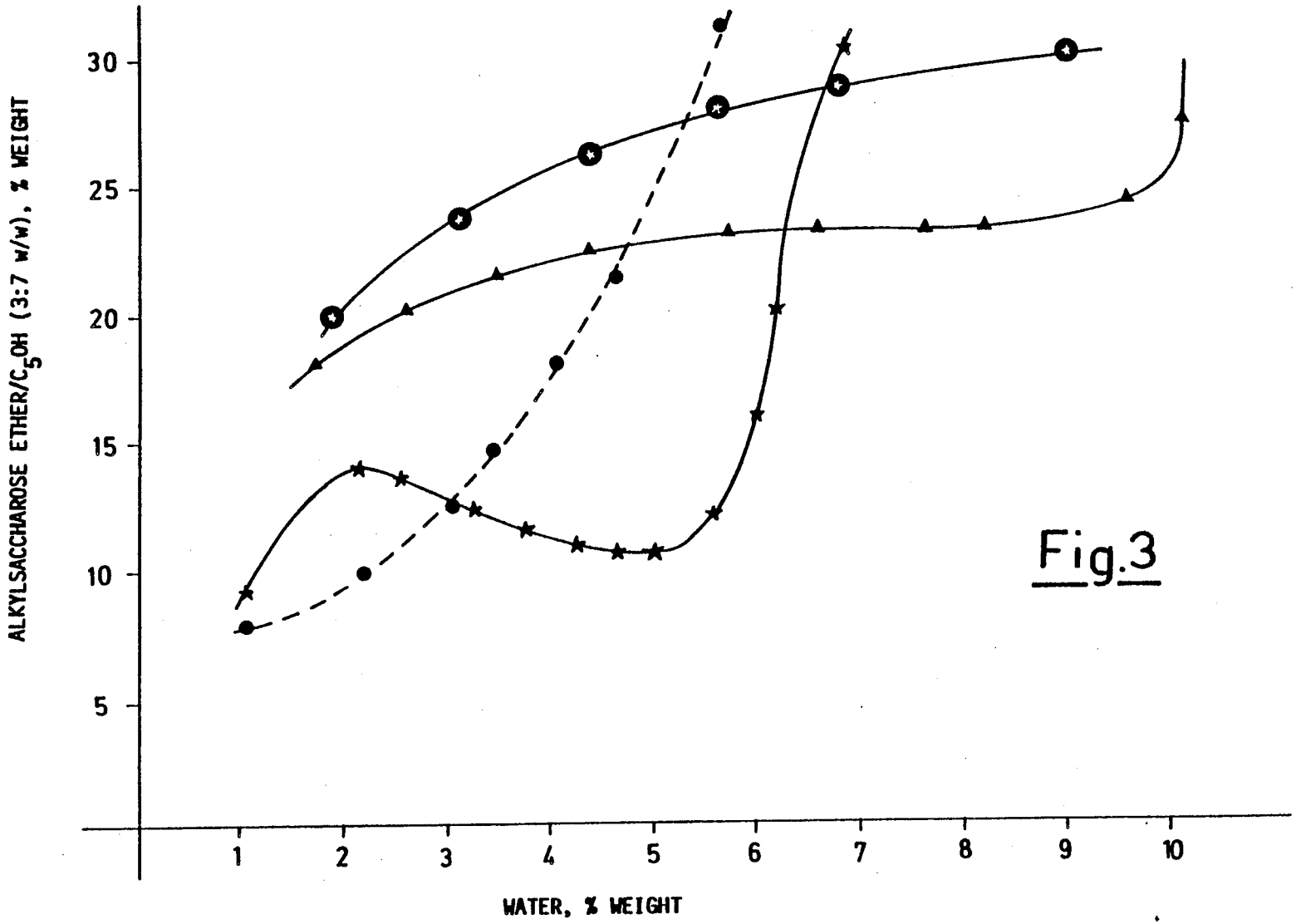

The procedure of Example 2 is followed, fixing the surfactant/n-pentanol weight ratio at 3:7 and using different alkyl saccharose ethers as surfactants. FIG. 3 shows the curves of surfactant/n-pentanol concentration against water concentration in the microemulsion for:

dodecyl saccharose ether (◉----◉)
tetradecyl saccharose ether (▲----▲)
saccharose ether "LIAL 145" (●----●)
oleyl saccharose either (★----★)

LIAL 145 (commercial name) is a mixture of $C_{14}$–$C_{15}$ secondary aliphatic alcohols, which are transformed into the relative alkyl halides before reacting with saccharose to give the relative saccharose ethers.

EXAMPLE 4

Figure 5:
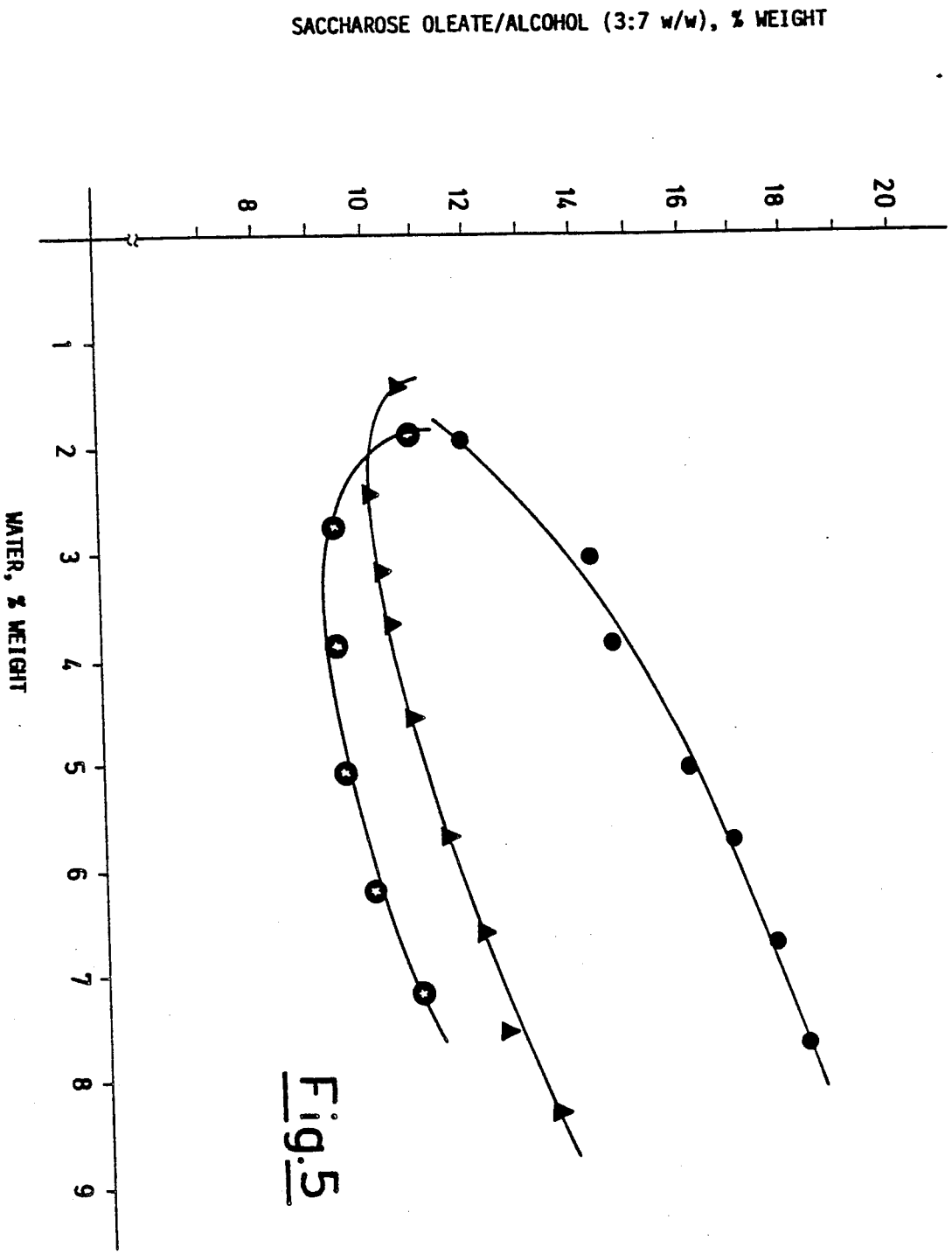

The procedure of Example 1 is followed, using saccharose oleate as surfactant and n-butanol, n-pentanol and n-hexanol as co-surfactant, with a surfactant/co-surfactant weight ratio of 3:7. FIG. 5 shows the curves of surfactant/co-surfactant mixture concentration [(●----●) for n-butanol, (▲----▲) for n-pentanol and (◉----◉) for n-hexanol] against water concentration in the microemulsion.

EXAMPLE 5

Figure 4:
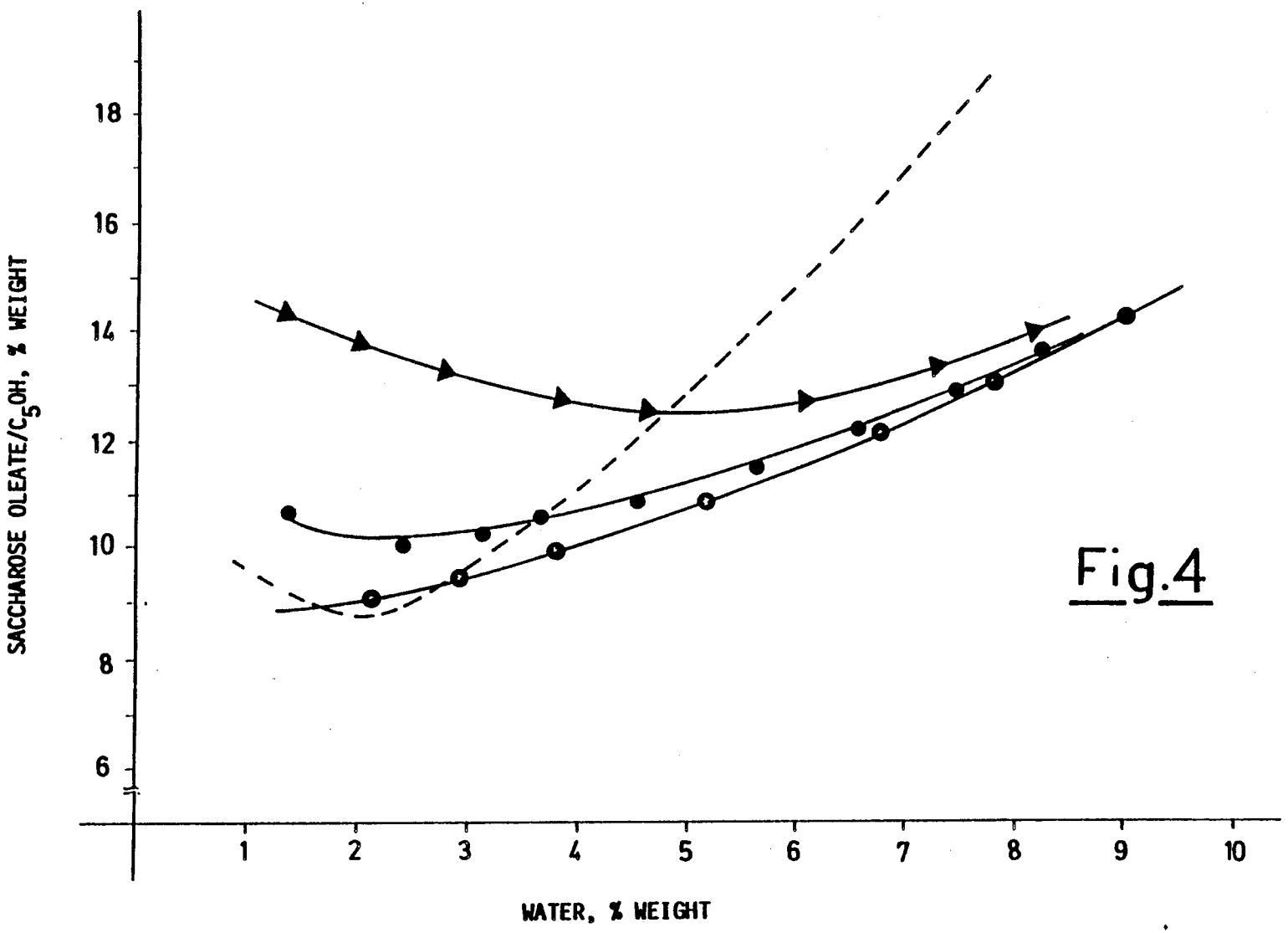

The procedure of Example 2 is followed, using saccharose oleate as surfactant and n-pentanol as co-surfactant. FIG. 4 shows the curves of concentration of surfactant/co-surfactant mixtures in the following weight ratios: 20:80 (-----), 25:75 (◉----◉), 30:70 (●----●) and 40:60 (►----►), against water concentration in the microemulsion.

The choice of n-pentanol in the present example is due to the fact that this co-surfactant is able to produce microemulsions stable at high temperature (about 70° C.), whereas under the same conditions compositions containing n-hexanol can develop a certain torbidity.

EXAMPLE 6

Figure 6:
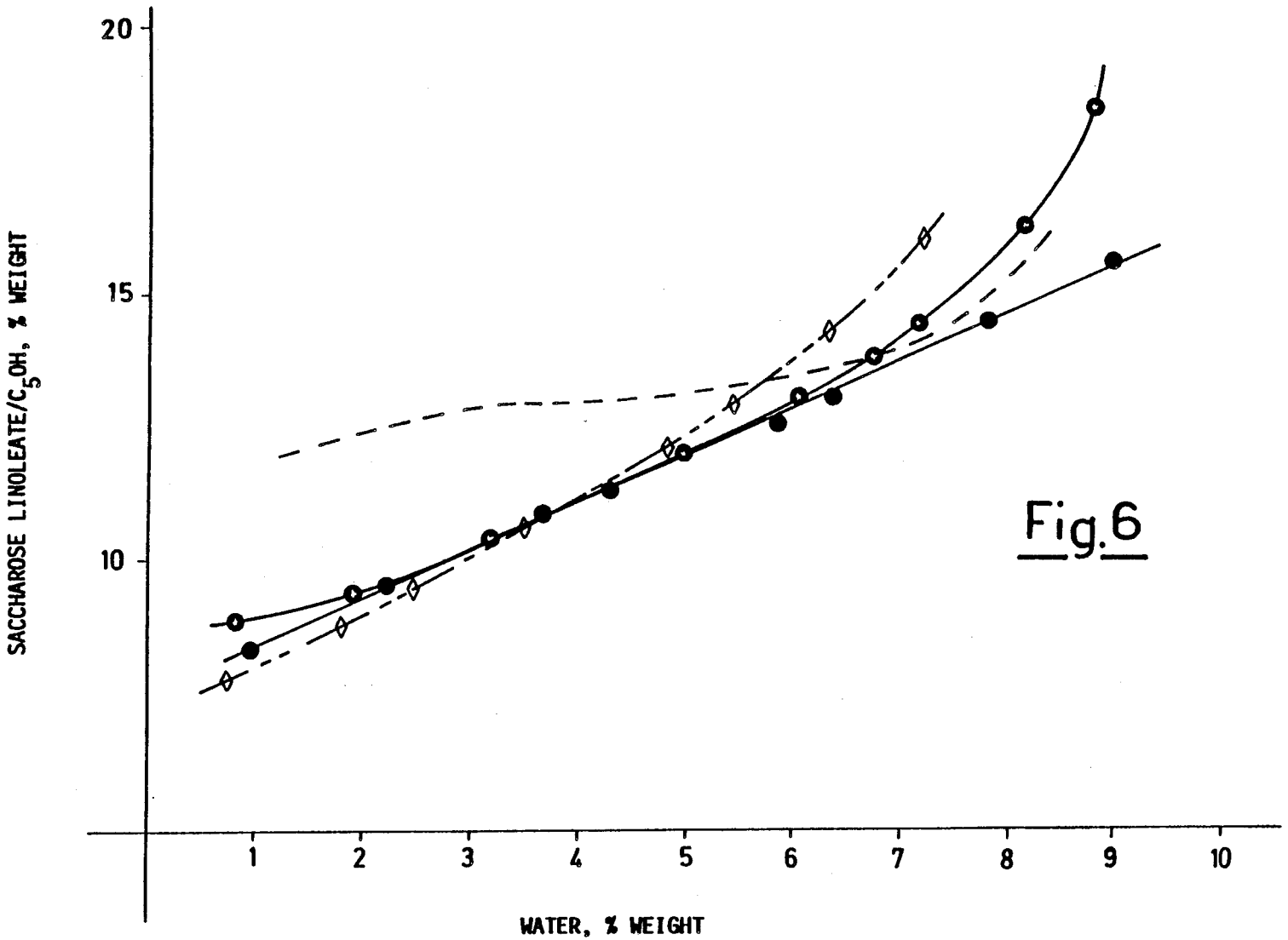

The procedure of Examples 2 and 4 is followed, using saccharose linoleate as surfactant and n-pentanol as co-surfactant. FIG. 6 shows the curves of concentration of surfactant/co-surfactant mixtures in the following weight ratios: 20:80 (◇----◇), 25:75, (⊙----⊙), 30:70 (●----●) and 40:60 (----), against water concentration in the microemulsion.

Table 1 shows the concentrations of the individual constituents, expressed in percentage by weight, of some water-in-diesel fuel microemulsion samples stabilized by adding glycolipids in mixture with n-pentanol.

Table 2 shows the composition of some water-in-diesel fuel microemulsion and their stability at various temperatures. The symbol (+) in the table represents a transparent solution, whereas the symbol (−) represents a turbid solution. The samples were observed after 2 hours of temperature control at the temperatures indicated. When the samples were temperature-controlled at 2° C. no demixing occurred.

TABLE 1

| No. | WATER | DIESEL | DODECYL SACCHA-ROSE ETHER | TETRADECYL SACCHAROSE ETHER | "LIAL 145" SACCHA-ROSE ETHER | OLEYL SACCHA-ROSE | SACCHA-ROSE OLEATE | SACCHAROSE LINOLEATE | $C_5OH$ |
|---|---|---|---|---|---|---|---|---|---|
| 1 | 1.80 | 78.5 | 5.91 | — | — | — | — | — | 13.79 |
| 2 | 3.0 | 73.4 | 7.08 | — | — | — | — | — | 16.52 |
| 3 | 4.3 | 69.4 | 7.89 | — | — | — | — | — | 18.41 |
| 4 | 5.5 | 67.0 | 8.40 | — | — | — | — | — | 19.60 |
| 5 | 6.7 | 64.7 | 8.58 | — | — | — | — | — | 20.02 |
| 6 | 8.9 | 61.34 | 8.93 | — | — | — | — | — | 20.83 |
| 7 | 1.6 | 80.4 | — | 5.40 | — | — | — | — | 12.60 |
| 8 | 2.5 | 77.5 | — | 6.00 | — | — | — | — | 14.00 |
| 9 | 3.4 | 75.0 | — | 6.48 | — | — | — | — | 15.12 |
| 10 | 4.3 | 73.1 | — | 6.78 | — | — | — | — | 15.82 |
| 11 | 5.6 | 71.6 | — | 6.84 | — | — | — | — | 15.96 |
| 12 | 6.5 | 70.7 | — | 6.84 | — | — | — | — | 15.96 |
| 13 | 7.5 | 69.5 | — | 6.90 | — | — | — | — | 16.10 |
| 14 | 8.25 | 68.35 | — | 7.02 | — | — | — | — | 16.38 |
| 15 | 9.50 | 66.3 | — | 7.26 | — | — | — | — | 16.94 |
| 15b | 10.0 | 62.6 | — | 8.22 | — | — | — | — | 19.18 |
| 16 | 1.0 | 91.0 | — | — | 2.40 | — | — | — | 5.60 |
| 17 | 2.0 | 88.6 | — | — | 2.82 | — | — | — | 6.53 |
| 18 | 3.0 | 84.6 | — | — | 3.72 | — | — | — | 8.68 |
| 19 | 3.5 | 81.5 | — | — | 4.50 | — | — | — | 10.50 |
| 20 | 4.0 | 78.0 | — | — | 5.40 | — | — | — | 12.60 |
| 21 | 4.5 | 73.5 | — | — | 6.60 | — | — | — | 15.40 |
| 22 | 5.5 | 64.5 | — | — | 9.00 | — | — | — | 21.00 |
| 23 | 1 | 91.0 | — | — | — | 2.40 | — | — | 5.60 |
| 24 | 2.1 | 83.9 | — | — | — | 4.20 | — | — | 9.80 |
| 25 | 2.5 | 83.9 | — | — | — | 4.08 | — | — | 9.52 |
| 26 | 3.2 | 84.8 | — | — | — | 3.60 | — | — | 8.40 |
| 27 | 3.7 | 85.1 | — | — | — | 3.36 | — | — | 7.84 |
| 28 | 4.2 | 85.1 | — | — | — | 3.21 | — | — | 7.49 |
| 29 | 4.6 | 84.7 | — | — | — | 3.21 | — | — | 7.49 |
| 30 | 5.0 | 84.5 | — | — | — | 3.15 | — | — | 7.35 |
| 31 | 5.6 | 82.0 | — | — | — | 3.72 | — | — | 8.68 |
| 32 | 6.1 | 76.9 | — | — | — | 5.10 | — | — | 10.90 |
| 33 | 1.30 | 89.9 | — | — | — | — | 2.20 | — | 6.60 |
| 34 | 2.10 | 88.9 | — | — | — | — | 2.25 | — | 6.75 |
| 35 | 2.90 | 87.6 | — | — | — | — | 2.37 | — | 7.13 |
| 36 | 3.75 | 86.35 | — | — | — | — | 2.48 | — | 7.42 |
| 37 | 4.50 | 85.10 | — | — | — | — | 2.60 | — | 7.80 |
| 38 | 5.10 | 84.10 | — | — | — | — | 2.70 | — | 8.10 |
| 39 | 5.75 | 82.85 | — | — | — | — | 2.85 | — | 8.55 |
| 40 | 6.30 | 81.70 | — | — | — | — | 3.00 | — | 9.00 |
| 41 | 7.00 | 80.5 | — | — | — | — | 3.13 | — | 9.37 |
| 42 | 7.80 | 79.4 | — | — | — | — | 3.20 | — | 9.60 |
| 43 | 8.20 | 78.3 | — | — | — | — | 3.38 | — | 10.12 |
| 44 | 0.90 | 90.7 | — | — | — | — | — | 2.52 | 5.88 |
| 45 | 2.15 | 87.65 | — | — | — | — | — | 3.06 | 7.14 |
| 46 | 2.70 | 86.9 | — | — | — | — | — | 3.12 | 7.28 |
| 47 | 3.20 | 86.1 | — | — | — | — | — | 3.21 | 7.49 |
| 48 | 4.20 | 84.1 | — | — | — | — | — | 3.51 | 8.19 |
| 49 | 4.70 | 83.5 | — | — | — | — | — | 3.54 | 8.26 |
| 50 | 5.20 | 82.9 | — | — | — | — | — | 3.57 | 8.33 |
| 51 | 5.80 | 81.6 | — | — | — | — | — | 3.78 | 8.82 |
| 52 | 6.60 | 79.9 | — | — | — | — | — | 4.05 | 9.45 |
| 53 | 7.30 | 78.3 | — | — | — | — | — | 4.32 | 10.08 |

TABLE 2

| No. | WATER | DIESEL | $C_5OH$ | OLEYL SACCHAROSE ETHER | SACCHA-ROSE OLEATE | SACCHA-ROSE LINOLEATE | 2° C. | 30° C. | 50° C. | 60° C. | 70° C. | 80° C. |
|---|---|---|---|---|---|---|---|---|---|---|---|---|
| 1 | 1.88 | 84.93 | 9.22 | 3.95 | | | + | + | + | + | + | |
| 2 | 3.33 | 83.50 | 9.21 | 3.95 | | | + | + | + | + | + | |
| 3 | 3.92 | 83.21 | 9.00 | 3.85 | | | + | + | + | + | + | |

TABLE 2-continued

| No. | WATER | DIESEL | $C_5OH$ | OLEYL SACCHAROSE ETHER | SACCHA-ROSE OLEATE | SACCHA-ROSE LINOLEATE | 2° C. | 30° C. | 50° C. | 60° C. | 70° C. | 80° C. |
|---|---|---|---|---|---|---|---|---|---|---|---|---|
| 4 | 5.16 | 81.39 | 9.41 | 4.03 | | | + | + | + | + | + | |
| 5 | 5.68 | 80.94 | 9.36 | 4.01 | | | + | + | + | − | − | |
| 6 | 3.46 | 83.58 | 9.06 | 3.88 | | | + | + | + | + | − | |
| 7 | 4.27 | 81.34 | 10.07 | 4.31 | | | + | + | + | + | − | |
| 8 | 4.99 | 78.74 | 11.38 | 4.87 | | | + | + | + | + | + | |
| 9 | 5.48 | 73.09 | 15.0 | 6.42 | | | + | + | + | + | + | |
| 10 | 2.90 | 87.60 | 7.13 | | 2.37 | | + | + | + | + | + | + |
| 11 | 3.75 | 86.35 | 7.42 | | 2.48 | | + | + | + | + | + | + |
| 12 | 5.10 | 84.10 | 8.10 | | 2.70 | | + | + | + | + | + | + |
| 13 | 6.30 | 81.70 | 9.00 | | 3.00 | | + | + | + | + | + | + |
| 14 | 7.00 | 80.50 | 9.37 | | 3.13 | | + | + | + | + | + | + |
| 15 | 7.80 | 79.40 | 9.60 | | 3.20 | | + | + | + | + | + | + |
| 16 | 3.10 | 86.60 | 7.21 | | 3.09 | | + | + | + | + | + | + |
| 17 | 3.60 | 85.80 | 7.42 | | 3.18 | | + | + | + | + | + | + |
| 18 | 5.60 | 83.00 | 7.98 | | 3.40 | | + | + | + | + | + | + |
| 19 | 6.50 | 80.80 | 8.89 | | 3.81 | | + | + | + | + | + | + |
| 20 | 7.40 | 80.20 | 8.68 | | 3.70 | | + | + | + | + | + | + |
| 21 | 3.60 | 85.50 | 7.63 | | | 3.27 | + | + | + | + | + | |
| 22 | 4.20 | 84.10 | 8.19 | | | 3.51 | + | + | + | + | + | |
| 23 | 5.25 | 82.95 | 8.26 | | | 3.54 | + | + | + | + | + | |
| 24 | 6.30 | 80.60 | 9.17 | | | 3.93 | + | + | + | + | + | |
| 25 | 5.80 | 81.60 | 8.82 | | | 3.78 | + | + | + | + | + | |
| 26 | 7.70 | 77.40 | 10.43 | | | 4.47 | + | + | + | + | + | |
| 27 | 1.60 | 89.30 | 7.28 | | | 1.82 | + | + | + | + | + | |
| 28 | 2.40 | 88.20 | 7.52 | | | 1.88 | + | + | + | + | + | |
| 29 | 3.40 | 86.20 | 8.32 | | | 2.08 | + | + | + | + | + | |
| 30 | 4.90 | 82.20 | 10.32 | | | 2.58 | + | + | + | + | + | |
| 31 | 5.20 | 81.80 | 10.40 | | | 2.60 | + | + | + | + | + | |
| 32 | 6.00 | 79.70 | 11.44 | | | 2.86 | + | + | + | − | − | |

We claim:

1. A diesel fuel microemulsion, comprising a diesel fuel, water, a glycolipid surfactant, and an aliphatic alcohol co-surfactant.

2. A microemulsion as defined in claim 1, wherein said glycolipid surfactant is represented by the formula

A—X—R;

wherein A is a glucide group of a mono-saccharide, di-saccharide, tri-saccharide or tetra-saccharide; R is an alkyl group, comprising at least 10 carbon atoms, and selected from the group consisting of saturated linear chain alkyl groups, saturated branched chain alkyl groups, mono-unsaturated linear chain alkyl groups, mono-unsaturated branched chain alkyl groups, polyunsaturated linear chain alkyl groups, and polyunsaturated branched chain alkyl groups; and wherein X is selected from the group consisting of ether functions, ester functions, acetal functions and hemiacetal functions.

3. A microemulsion as defined in claim 2, wherein A is saccharose and R is an alkyl group comprising from 10 to 24 carbon atoms.

4. A microemulsion as defined in claim 3, wherein said surfactant is selected from the group consisting of oleyl saccharose ether, tetradecyl saccharose ether, dodecyl saccharose ether, saccharose oleate, and saccharose linoleate.

5. A microemulsion as defined in claim 4, wherein said co-surfactant is selected from the group consisting of primary aliphatic alcohols containing from 4 to 6 carbon atoms per molecule, secondary aliphatic alcohols containing from 4 to 6 carbon atoms per molecule, and mixtures of the foregoing.

6. A microemulsion as defined in claim 5, wherein said co-surfactant is selected from the group consisting of n-butanol, n-pentanol, and n-hexanol.

7. A microemulsion as defined in claim 1, wherein said diesel fuel is diesel fuel No. 2.

8. A microemulsion as defined in claim 1, comprising from 60 to 91 weight percent diesel fuel, from 1 to 10 weight percent water, from 1.7 to 9 weight percent glycolipid surfactant, and from 6.3 to 21 weight percent co-surfactant.

9. A microemulsion as defined in claim 8, comprising from 60 to 90 weight percent diesel fuel; from 1 to 10 weight percent water; from 2.7 to 9 weight percent alkyl saccharose ether comprising from 10 to 24 carbon atoms in the alkyl portion; and from 6.3 to 21 weight percent co-surfactant.

10. A microemulsion as defined in claim 9, comprising from 80 to 89.3 weight percent diesel fuel, from 1 to 6 weight percent water, from 2.9 to 4.2 weight percent oleyl saccharose ether, and from 6.8 to 9.8 weight percent n-pentanol.

11. A microemulsion as defined in claim 8, comprising from 72.1 to 90.6 weight percent diesel fuel; from 1 to 8 weight percent water; from 1.7 to 4.7 weight percent saccharose alkanoate comprising from 10 to 24 carbon atoms in the alkanoate portion; and from 6.7 to 15.2 weight percent co-surfactant.

12. A microemulsion as defined in claim 11, comprising from 78.5 to 89.1 weight percent diesel fuel, from 2 to 8 weight percent water, from 2.2 to 4 weight percent saccharose oleate, and from 6.7 to 9.5 weight percent n-pentanol.

13. A microemulsion as defined in claim 11, comprising from 76.5 to 89 weight percent diesel fuel, from 2 to 8 weight percent water, from 1.8 to 4 weight percent saccharose linoleate, and from 7.2 to 11.5 weight percent n-pentanol.

14. A diesel fuel microemulsion, consisting essentially of a diesel fuel, water, a glycolipid surfactant, and an aliphatic alcohol co-surfactant.

15. A microemulsion as defined in claim 14, wherein said glycolipid surfactant is represented by the formula

A—X—R;

wherein A is a glucide group of a mono-saccharide, di-saccharide, tri-saccharide or tetra-saccharide; R is an alkyl group, comprising at least 10 carbon atoms, and selected from the group consisting of saturated linear chain alkyl groups, saturated branched chain alkyl groups, mono-unsaturated linear chain alkyl groups, mono-unsaturated branched chain alkyl groups, polyunsaturated linear chain alkyl groups, and polyunsaturated branched chain alkyl groups; and wherein X is a unit selected from the group consisting of ether, ester, acetal and hemiacetal.

16. A microemulsion as defined in claim 15, wherein A is saccharose and R is an alkyl group comprising from 10 to 24 carbon atoms.

17. A microemulsion as defined in claim 16, wherein said surfactant is selected from the group consisting of oleyl saccharose ether, tetradecyl saccharose ether, dodecyl saccharose ether, saccharose oleate, and saccharose linoleate.

18. A microemulsion as defined in claim 17, wherein said co-surfactant is selected from the group consisting of primary aliphatic alcohols containing from 4 to 6 carbon atoms per molecule, secondary aliphatic alcohols containing from 4 to 6 carbon atoms per molecule, and mixtures of the foregoing.

19. A microemulsion as defined in claim 18, wherein said co-surfactant is selected from the group consisting of n-butanol, n-pentanol, and n-hexanol.

20. A microemulsion as defined in claim 14, wherein said diesel fuel is diesel fuel No. 2.

* * * * *